United States Patent [19]

Kunz

[11] Patent Number: 4,938,606

[45] Date of Patent: Jul. 3, 1990

[54] METHOD OF AND AN APPARATUS FOR PRODUCING A WATER-IN-OIL EMULSION

[75] Inventor: Gerold Kunz, Zürich, Switzerland

[73] Assignee: Zugol AG, Switzerland

[21] Appl. No.: 104,372

[22] Filed: Oct. 5, 1987

[30] Foreign Application Priority Data

Oct. 8, 1986 [CH] Switzerland ..... 4013/86
Jul. 13, 1987 [CH] Switzerland ..... 2664/87

[51] Int. Cl.[5] ..... B01F 15/02; B01F 3/08

[52] U.S. Cl. ..... 366/134; 366/136; 366/152; 366/162; 366/164; 366/165; 366/179; 123/25 R; 123/25 E; 48/180.1

[58] Field of Search ..... 366/131, 134, 136, 137, 366/150, 152, 154, 155, 160–168, 172, 173, 176, 177, 180, 184, 191, 179, 194–196, 262–265, 190, 279; 261/18.2, 18.4, DIG. 66; 48/63, 75, 84, 85.2, 105, 107, 93, 94, 180.1, 181, 184, 186, 212–214, 214 R; 60/39.53, 39.05, 39.59, 39.30, 613, 619; 123/590, 25 A, 25 E

[56] References Cited

U.S. PATENT DOCUMENTS

| | | | |
|---|---|---|---|
| 2,392,565 | 1/1946 | Anderson et al. | 261/DIG. 66 |
| 2,599,985 | 6/1952 | Fox et al. | 261/184 |
| 2,653,801 | 9/1953 | Fontain et al. | 366/165 |
| 2,664,871 | 1/1954 | Anderson | 261/18.4 |
| 3,251,653 | 5/1966 | Aditya | 366/165 |
| 3,547,408 | 12/1970 | Klingenberg | 366/163 |
| 3,994,480 | 11/1970 | Fothergill et al. | 366/165 |
| 4,227,817 | 10/1980 | Gerry | 261/18.2 |
| 4,233,265 | 11/1980 | Gasper | 366/177 |
| 4,337,032 | 6/1982 | Duplovy et al. | 366/165 |
| 4,398,827 | 8/1983 | Dietrich | 366/165 |
| 4,580,904 | 4/1986 | Hocherey | 366/137 |
| 4,664,528 | 5/1987 | Rodgers et al. | 366/137 |
| 4,688,945 | 8/1987 | Brozelton et al. | 366/163 |
| 4,778,280 | 10/1988 | Brozelton et al. | 366/165 |

*Primary Examiner*—Harvey C. Hornsby
*Assistant Examiner*—Joseph S. Machuga
*Attorney, Agent, or Firm*—Watson, Cole, Grindle & Watson

[57] ABSTRACT

The production of a water-in-oil emulsion proceeds by an exact dosing of the desired water-oil ratio in a dosing apparatus. The dosed mixture is fed into a mixing chamber for producing the emulsion proper. Thereafter, the emulsion is fed out of the chamber via a funnel-like narrowing outlet into a storage tank, within which the emulsion is kept in permanent motion. A partial quantity of the emulsion is drawn off this chamber and returned possibly together with newly made emulsion to the mixing chamber. A further partial quantity of the emulsion is drawn off the storage tank and fed to the consumer. The conveying of the mixture and maintaining of the circulation, resp. is achieved by a pump located ahead of the mixing chamber. The apparatus has specific application for the production of a water-in-oil emulsion for the operation of combustion engines or oil burners.

9 Claims, 2 Drawing Sheets

METHOD OF AND AN APPARATUS FOR PRODUCING A WATER-IN-OIL EMULSION

BACKGROUND OF THE INVENTION

1. FIELD OF THE INVENTION

The present invention relates to a method of producing a water-in-oil emulsion. It relates further to an apparatus for practising this method and further to a water-in-oil emulsion treatment apparatus for the preparation of water-in-oil emulsions for the operation of diesel engines of automotive vehicles and of stationary plants.

2. DESCRIPTION OF THE PRIOR ART

A large number of emulsifiers, i.e., chemical additives, are for producing at least temporarily stable emulsions, i.e., homogeneous mixtures of two materials which as such are not intermixable, such as for instance a water-oil liquid. A few mechanical methods for the production of emulsions are known too, whereby, however, the emulsions separate again after various time spans.

A number of applications, specifically in case of combustion machines and oil burners, require that a mixture of materials, e.g., an emulsion, must last in a certain condition during a short time span only.

It is a general object of the present invention to provide a method and an apparatus which reliably prepares in a as simple as possible procedure a water-in-oil emulsion as fuel for diesel engines specifically for an application in automotive vehicles. The admixing of water in fuels leads to a reduced fuel consumption, reduced harmful or obnoxious substances or to an increase of the output of combustion engines. Generally the water is to this end injected by a separate injection plant into the cylinder chamber and intermixes with the combustion fuel which has been injected shortly before the combustion.

This necessitates, however, an enormous additional expenditure regarding auxiliary devices at the engine proper and such are installed practically only on large diesel engines or in such instances in which a large output is needed during a short time span.

Due to the generation of additional harmful substances, chemical emulsifiers can not be considered for an application in combustion engines. Commonly known mechanical devices for the production of water-in-oil emulsions have the drawback that a constant mixture ratio can be produced with the necessary small mass flows in for instance, small diesel engines, which constant ratio is necessary for proper operation.

SUMMARY OF THE INVENTION

An object of the present invention is to provide a method of producing a water-in-oil emulsion comprising the steps of discharging from a water supply and a thereto separate oil supply requisite dosed quantities of water and oil, so as to provide a predetermined water quantity/oil quantity ratio; thereafter uniting these dosed quantities of water and oil; feeding the mixture produced thereby into a mixing chamber having a funnel-like reduced outlet whereby an emulsion is produced; conveying the emulsion out of the mixing chamber and into a storage chamber wherein the emulsion is kept in a state of permanent agitation; and of drawing a partial quantity of the emulsion from the storage chamber and feeding it, if necessary together with newly produced mixture again into the mixing chamber and according into a closed circulation, and of drawing a further partial quantity of the emulsion from the storing chamber and feeding such to a consuming device.

A further object is to provide an apparatus for practising the mentioned method and comprising a dosing means operative for producing a predetermined water quantity/oil quantity ratio; a mixing chamber having at least one tangential inlet and an axial funnel-like narrowing outlet; a connecting line extending between the dosing means and the mixing chamber and in which line the dosed quantities of water and oil are united; conveying means located in the connecting line; a storage chamber communicating with the outlet of the mixing chamber; which connecting line connecting the mixing chamber to the storage chamber leading also at least approximately tangentially into the storage chamber, which latter includes an outlet leading to the suction side of the conveying means and a further outlet for leading to the emulsion consuming device.

A specifically advantageous design for an application in engines for motor vehicles is an embodiment of the dosing means having diaphragm walls and a solenoid-operated lifting drive. Such is suitable for achieving a constant water-oil ratio at continuously changing conditions of operation. At the same time the apparatus incorporates a specifically advantageous emergency operation feature in that also in case of an interrupted power supply to the lifting drive, diesel fuel oil for driving the engine remains available in the conduits due to a corresponding sizing of the check valves and of the magnet.

It has been proven that it is of utmost importance for achieving a stable emulsion that the conveying means which produce a permanent dosed circulation in the apparatus is allowed to only gently accelerate the fluid or its components, such as can be achieved for instance by bent conveying blades of a low pressure rotary pump.

Likewise, the intermixing and the turbulence in the mixing chamber should not proceed abruptly. The mixing chamber is preferably of a hemispherical shape having two concentric compartments, whereby the inner compartment opens into a funnel-like narrowed section in which the emulsion is accelerated and the spin to which it had been made subject due to the tangential infeed into the outer compartment is increased as well, such that the intermixing is promoted further. This channel which is narrowed down in a funnel-like manner opens preferably into a preferably approximately cylindric expansion channel whereby an increase of the intermixing is achieved. Finally, this expansion channel, again narrowed down at its end, opens into a storage tank.

Due to a tangential inlet the emulsion is kept in a steady motion within the storage tank such that it will not separate and will remain stable.

The storage tank is provided with a connecting channel leading to the suction side of the conveying means such that as long as the conveying means are kept in operation a closed circulation is permanently maintained in the apparatus.

The storage tank is provided further with an outlet line such to feed the emulsion to a consumer, for instance to the injection pump of a diesel engine. This outlet is preferably located approximately in the same cross-sectional plane in the storage tank as the infeed from the mixing chamber. A hemispherically shaped portion of the storage tank having a venting opening at its zenith has proven to be an ideal design.

If the apparatus is used for an operation of a diesel engine of an automotive vehicle, small amounts of fuel leakages appear at the injection nozzles, that is in the present case leakages of emulsion, which must be returned. To this end, an additional connection at the suction area of the conveying means is foreseen.

It has been proven that a water to oil ratio of about 1:10 is specifically advantageous in case of an application in diesel engines. Specifically obnoxious materials such as soot, nitrogen oxides and carbon dioxyde are in comparison with an operation exclusively with diesel fuel oil distinctly reduced.

The application of the inventive apparatus for the production of a water in oil emulsion produces in combustion engines or oil burners an emulsion which remains substantially stable and constant regarding the water-oil ratio also in case of continuously changing conditions of operation, which contributes strongly to a reduction in the discharging of obnoxious materials.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

Figure 1:
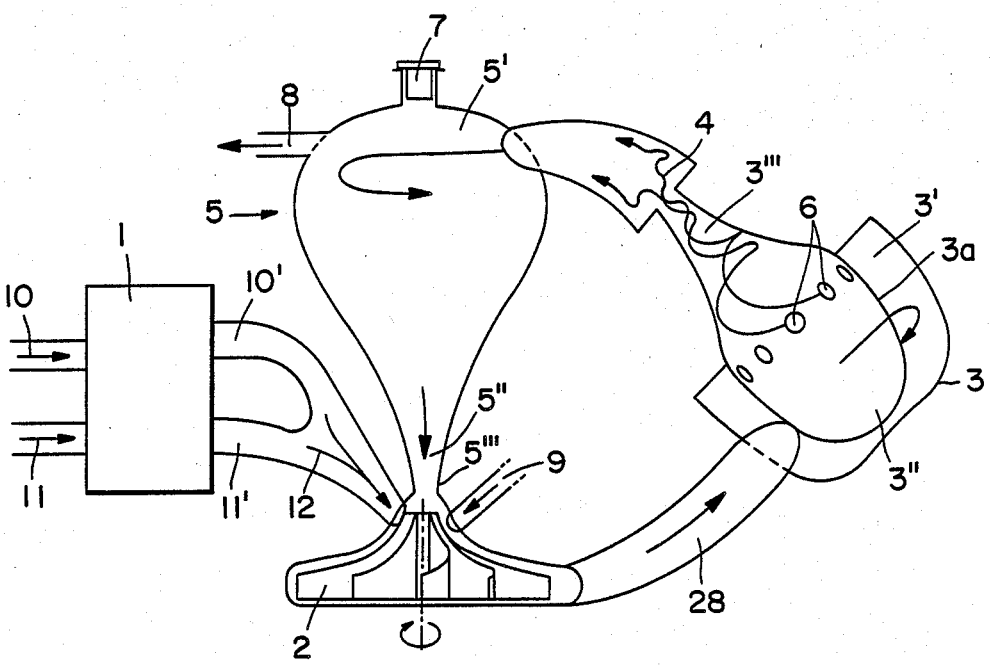
FIG. 1 is a schematic sectional view of an apparatus in accordance with the present invention.

FIG. 1 of the drawings illustrates the construction of an apparatus in accordance with the invention, in which the arrows represent the respective directions of flow of the emulsion, of the water and oil, resp. The water line 10 and the oil line 11 are led to a dosing apparatus, whereafter the exactly dosed quantities of these liquids are guided through the outlet lines 10' and 11', resp., into the manifold 12 to be united and to arrive at the suction side of a conveying pump, here a rotary pump 2. The mixture which is accelerated by the pump 2 flows through the feed line 28 and into the mixing chamber 3. This mixing chamber 3 is separated by a partition 3a shaped as a hemispherical dome into an outer compartment 3', into which the feed line 28 opens tangentially, and an inner compartment 3''. The partition 3a has circular perforations 6 which are chamfered approximately parallel to the direction of flow. Due to this design a particularly advantageous intermixing of the water-oil-mixture is arrived at and there is produced a water-in-oil emulsion. Due to the fact that the outfeeding portion 3''' of the mixing chamber 3, which communicates with the inner compartment 3'', is of a conically narrowing shape, a turbulence and intermixing of the water and oil particles is intensified. Finally, the portion 3''' of this vessel opens in the form of a sudden expansion into an expansion channel 4 before the emulsion enters finally the storage tank 5. By means of a tangential infeed into the storage tank 5 a permanent motion (vortex) of the emulsion in the storage tank 5 is achieved. In order to expell the air from the inside of the apparatus during its initial filling, the storage tank 5 is provided at its uppermost point with a venting opening 7. The outflow opening or line 8, which for instance in case of a diesel engine extends to the injection pump, is located preferably at the same height of the storage tank 5 as its tangential feeding line of the expansion channel 4. In order to secure a permanent availability of an ideal emulsion in the storage tank 5 a permanent circulation of the emulsion is maintained in the apparatus proper in that the storage tank 5 is provided at its lower end with a return channel 5'' extending to the conveying means 2.

Possible excess quantities of not consumed emulsion can also be returned into the circulation via the return line 9. This line 9 must in any case be located at the suction side of the conveying means 2.

Figure 2:
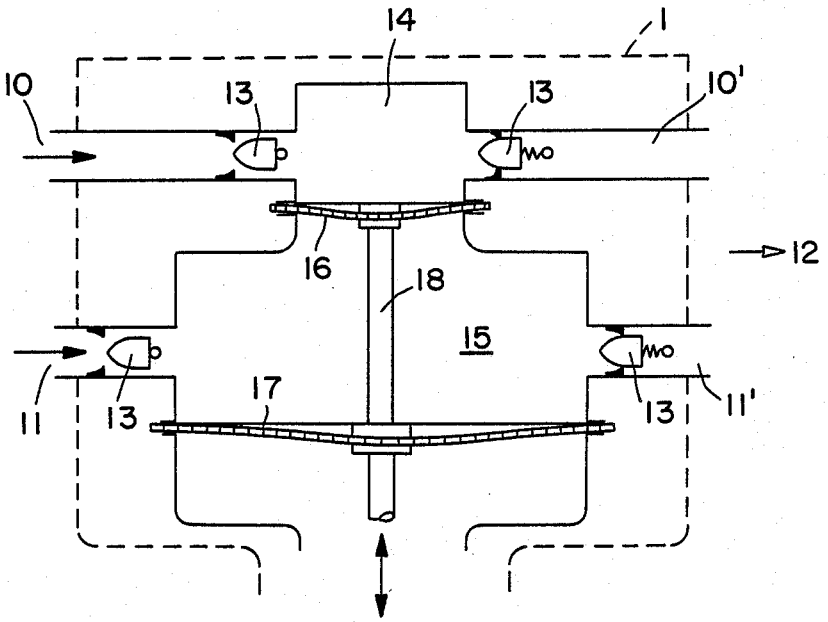
FIG. 2 is a schematic sectional view of a dosing apparatus.

The structure of the dosing apparatus is illustrated more in detail in FIG. 2. The dosing apparatus 1 includes a pump chamber 14 for water and a larger chamber 15 for oil (larger according to the desired water-in-oil ratio). Check valves 13 are mounted in the infeed lines 10, 11, resp., and in the discharge line 12.

The diaphragm walls 16, 17 are coupled to one another via a rigid operating rod 18 and are preferably coupled to a (not specifically illustrated) solenoid, i.e., electromagnetical drive of a generally known design which oscillatingly drives the diaphragms. By choosing corresponding respective dimensions of the pump chambers 14, 15 and of the diaphragm surfaces 16, 17, resp., water and oil can be fed thereby at a selected constant ratio into line 12. The through flow quantity can be adjusted either by changing the frequency of the movement of the diaphragms or by changing the stroke. Because the stroke in case of a solenoid drive is not steady and depends rather from the backpressure, no specific controlling of the quantity through-put through the dosing apparatus is needed By a corresponding selection of the dimensions of the lifting magnet, an already small pressurizing of the conduit 12, e.g., if no or a small amount only of the emulsion is extracted from the storage tank 5, is sufficient to keep the respective check valves 13 closed. If a large quantity of emulsion is needed, a low pressure in line 12 produces a low back pressure in the chambers 14,15 and the lifting magnet produces a large stroke, resulting in a corresponding large quantity through flow.

A further large advantage is exhibited by the emergency operation feature of the dosing apparatus in that in case of a defective drive of the diaphragm 16, 17, the water line 10 is closed off by the check valve 13 of this line (in case the valve has a correspondingly dimensioned spring) which exerts a larger pressure than the pressure prevailing in the water feed line. The oil feed via line 11 proceeds advantageously a pump by means of which generates a pressure which is large enough to keep both valves in line 11 and line 11', resp., open and thus to keep up the oil supply to the apparatus. This securely maintains a trouble-less operation of, for instance, a diesel engine by oil only.

Figure 3:
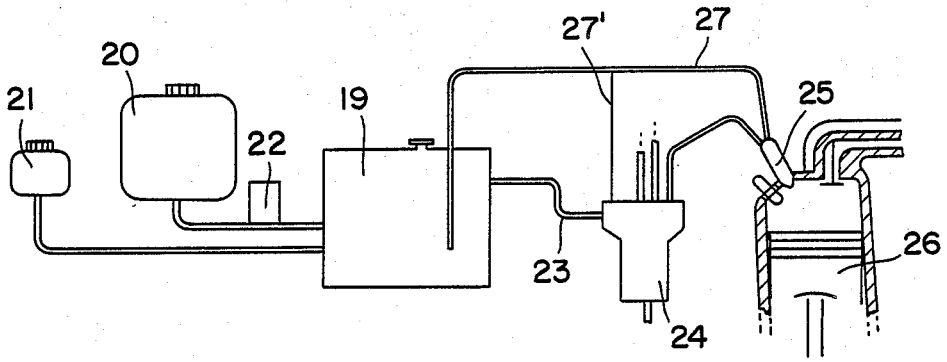
FIG. 3 illustrates a circuit diagram showing the arrangement of the apparatus for operation with a diesel-injection engine.

A connecting diagram of the entire apparatus 19 to a motor vehicle diesel engine 26 is illustrated in FIG. 3. The water tank 21 should be mounted somewhat elevated relative to the connection of the apparatus 19 but the oil tank 20 can be located arbitrarily because a conveying pump 22 is located therebetween. The discharge line 23 from the storage tank 5 of the apparatus 19 leads to the injection pump 8A. From there the emulsion flows via the injection nozzles 25 into the combustion chamber of the diesel engine 26. The leakage lines 27, 27' are coupled to the return flow connection 9 (FIG. 1) of the apparatus 19.

While there is shown and described a present preferred embodiment of the invention, it is to be distinctly understood that the invention is not limited thereto, but may be otherwise variously embodied and practised within the scope of the following claims.

I claim:

1. An apparatus for producing a water-oil emulsion for use in an emulsion-consuming device, said apparatus comprising:

a dosing means for providing separate dosed quantities of water and oil in predetermined quantity ratios, a mixing chamber for forming the water-oil emulsion having a tangential inlet and an axial, funnel-like narrowing outlet, a first connecting line extending between said dosing means and the tangential inlet of said mixing chamber and in which the separate dosed quantities of water and oil are united, a conveying means located in said connecting line, a storage container which includes a first outlet connected to said first connecting line on a suction side of said conveying means and a second outlet for supplying the water-oil emulsion to an emulsion-consuming device, and a second connecting line connecting the outlet of said mixing chamber with said storage container, said second connecting line including an expansion chamber to which the outlet of said mixing chamber is connected.

2. The apparatus of claim 1, wherein both said mixing chamber and said storage container have a shape which is symmetrical.

3. The apparatus as claimed in claim 1, wherein said dosing means comprises at least two chambers located separately from and directly adjacent each other and sized differently in accordance with the desired water quantity/oil quantity ratio, which two chambers are separated from each other by a partition in form of a first diaphragm and in which the larger of said chambers includes a second diaphragm which has a relatively large surface corresponding to the desired water/oil ratio and is coupled to said first diaphragm by a rigid rod and to a means for inducing a motion, and in which each chamber is provided with an infeed and a discharge line of which each includes one check valve.

4. The apparatus of claim 3, wherein said motion inducing means of said dosing means includes a lifting solenoid.

5. The apparatus of claim 3, comprising a return line for unused emulsion connected to said first connecting line on a suction side of the conveying means.

6. The apparatus of claim 1, wherein said conveying means comprises an electrically-operated low pressure pump.

7. The apparatus of claim 1, wherein said mixing chamber comprises an upper hemispherically-shaped compartment to which said tangential inlet is connected and a lower compartment which provides said axial, funnel-like narrowing outlet.

8. The apparatus of claim 7, wherein said mixing chamber includes a partition in said upper compartment to provide inner and outer chambers, said partition being shaped as a hemispherical dome and having perforations, and wherein only the inner chamber communicates with the funnel-shaped lower compartment.

9. The apparatus of claim 1, wherein said storage container comprises an upper hemispherical space and a flunnel-like lower space which narrows into said first outlet, said second outlet being connected to said upper hemispherical space and said second connecting line being connected to said upper hemispherical space, said second outlet and the connection of said second connecting line lying in a common plane perpendicular to an axis of said storage container.

* * * * *